United States Patent [19]

Johnstone et al.

[11] 4,069,880

[45] * Jan. 24, 1978

[54] EXCAVATION TOOL

[75] Inventors: David C. Johnstone, Claysburg RD; John F. Kita, Bedford, both of Pa.

[73] Assignee: Kennametal Inc., Latrobe, Pa.

[ * ] Notice: The portion of the term of this patent subsequent to Apr. 24, 1993, has been disclaimed.

[21] Appl. No.: 363,654

[22] Filed: May 24, 1973

[51] Int. Cl.[2] ..... E21C 13/00

[52] U.S. Cl. ..... 175/410; 175/417

[58] Field of Search ..... 175/417, 410, 329

[56] References Cited

U.S. PATENT DOCUMENTS

| | | | |
|---|---|---|---|
| 2,689,109 | 9/1954 | Curtis | 175/417 |
| 3,071,201 | 1/1963 | Phipps | 175/410 |
| 3,185,228 | 5/1965 | Kelly | 175/410 |
| 3,269,470 | 8/1966 | Kelly | 175/410 |
| 3,346,060 | 10/1967 | Beyer | 175/410 |
| 3,357,507 | 12/1967 | Stewart | 175/410 |
| 3,388,756 | 6/1968 | Varel | 175/410 |
| 3,519,092 | 7/1970 | Miller | 175/410 |
| 3,537,539 | 11/1970 | Adcock | 175/413 |
| 3,618,683 | 11/1971 | Hughes | 175/410 |
| 3,693,736 | 9/1972 | Gardner | 175/410 |
| 3,717,209 | 2/1973 | Sheldon et al. | 175/413 |
| 3,749,190 | 7/1973 | Shipman | 175/374 X |
| 3,788,409 | 1/1974 | Curington | 175/410 |
| 3,858,671 | 1/1975 | Kita et al. | 175/406 X |

*Primary Examiner*—Ernest R. Purser
*Assistant Examiner*—Richard E. Favreau
*Attorney, Agent, or Firm*—Melvin A. Crosby; Lawrence R. Burns

[57] ABSTRACT

An excavation tool, specifically, a down-the-hole bit which reduces a formation by being impacted axially against a formation while rotating and through which a supply of fluid, such as air, is supplied through a passage in the bit to the working face thereof to blow away the material taken by the bit and wherein the working face of the bit is provided with grooves extending outwardly from the lower end of the fluid supply passage to the periphery of the bit and in communication with axial grooves formed in the bit. The provision of the grooves in the working end of the bit in communication with the axial grooves in the outer periphery of the bit greatly improves the removal of debris which accumulates at the bottom of the hole being drilled and increases the efficiency of the bit.

4 Claims, 3 Drawing Figures

EXCAVATION TOOL

The present invention relates to excavation tools, and particularly to down-the-hole bits, and is most particularly concerned with an arrangement for improving the removal of debris from the bottom of the hole being drilled during working operations.

Down-the-hole bits are well known and, in general, comprise a heavy steel body having one end forming the working face exposed. The working face is usually provided with hard wear resistant inserts, such as tungsten carbide inserts, which protrude from the working face, while the other end of the bit is adapted for receiving axial impacts. The impacts delivered to the bit cause the hard inserts therein to reduce formations to which the bit is presented and during working operations the bit is also rotated about the longitudinal axis.

The bits are usually provided with a bore extending axially therethrough and a cleansing fluid, such as air, is supplied through the bore to the lower working face of the bit, and this blows away debris consisting of material taken by the bit and, likewise, cools the working face of the bit.

To provide passage for the debris, the bits are provided with longitudinal or axial grooves or flutes in the outer periphery. Heretofore, the working faces of the bits have been substantially planar with the hole through which the air is supplied being formed therein. In many formations, this arrangement is satisfactory for blowing the material taken by the bit radially outwardly and backwardly along the grooves in the periphery of the bit.

At other times, however, the cleansing action of the air is not efficient and it has been discovered that greatly improved removal of the debris can be had by providing axially facing radial grooves in the working face of the bit leading from the hole through which the air is supplied outwardly to the lower ends of the axial grooves or flutes formed in the outer surface of the bit body.

With the foregoing in mind, a primary objective of the present invention is the provision of a down-the-hole bit having an improved arrangement for removing debris from the bottom of the hole being drilled by the bit.

Another objective of the present invention is the provision of an arrangement in a down-the-hole bit for enhancing the removal of the debris from the hole being drilled which does not in any way decrease the strength of the bit or interfere in any way with the operation thereof.

Still another object is the provision of a down-the-hole bit having improved operating characteristics and a more rapid cutting action because of an arrangement for rapidly removing from the working face of the bit debris taken from the bottom of the hole being drilled.

These and other objects and advantages of the present invention will become more apparent upon reference to the following detailed specification taken in conjunction with the accompanying drawings in which.

BRIEF SUMMARY OF THE INVENTION

A down-the-hole bit according to the present invention has a bit body which can be considered to be circular in transverse cross section and elongated with an upper end adapted for receiving impacts and provided with means for rotating the bit body during the impacting thereof.

The end of the bit body opposite the end which receives the impacts is the working face and is substantially planar and perpendicular to the longitudinal axis of the bit and mounted in the working face in distributed relation are hard metallic carbide inserts such as cemented tungsten carbide and which protrude axially from the working face for direct engagement with a formation to be reduced.

The bit preferably comprises gauge inserts extending angularly at the periphery of the working face so as to inhibit reduction in diameter of the bit which could cause difficulties in case the bit were to be withdrawn from the hole and a new one inserted.

The bit body has an axial passage therethrough through which a fluid, such as air, is supplied to a point within the limits of the working face. According to the present invention, this point is offset radially from the longitudinal axis of the bit and grooves are provided in the working face communicating at the inner end with the bore which emerges through the working face of the bit at the said point while at the other ends the grooves terminate at the periphery of the bit body.

The bit body is, furthermore, provided with axial grooves or flutes extending from the working end at least partly therealong through which material taken by the bit at the working end is blown away from the bit by the air supplied through the axial passage in the bit. The grooves in the working face of the bit at their outer ends communicate with the axial flutes formed in the bit body and greatly enhance the rate at which the material taken by the bit is blown away from the bottom of the hole being drilled.

The rapid removal of the material, or debris, taken by the bit leaves the bottom of the hole being drilled relatively clean so that efficient direct engagement of the bottom of the hole by the inserts in the bit body is had at all times and it has been found that the cutting action of the bit is thereby greatly enhanced. Furthermore, inasmuch as the debris is quickly removed from the drilling area, there is less time for this material to be pounded into a fine powder. The arrangement of the present invention, thus, reduces substantially the amount of dust generated in a down-the-hole drilling operation.

DETAILED DESCRIPTION OF THE INVENTION

Figure 1:
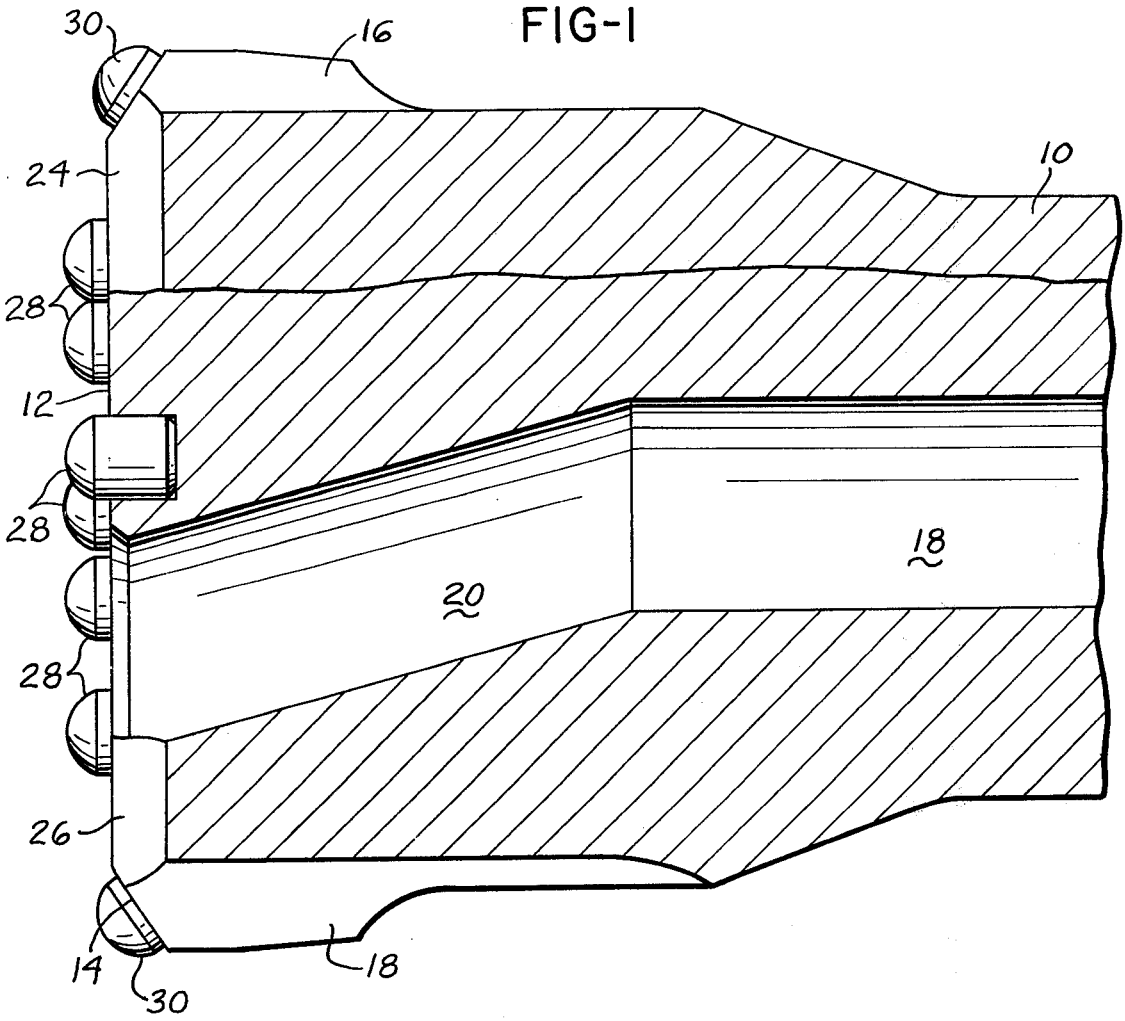
FIG. 1 is a sectional view indicated by line I—I on FIG. 2.
Figure 2:
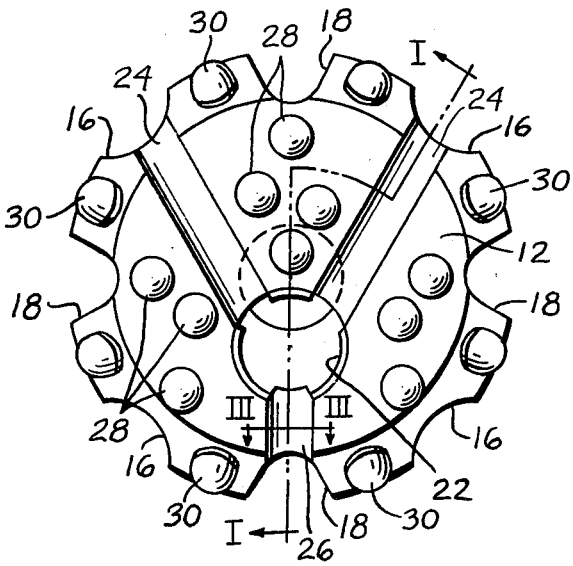
FIG. 2 is a view looking in at the bottom of the bit of FIG. 1.

Referring to the drawings somewhat more in detail, in FIGS. 1 and 2, the down-the-hole bit, of which only the lower portion is shown, comprises a body 10. At the end of the body 10, not shown, the body is provided with conventional means to retain it in a drill string and to receive impacts from a hammer. At the lower end of the bit, the bit body terminates in a planar working face 12, the periphery of which is bevelled off as at 14.

The lower portion of the bit body will be seen to taper in the generally outward direction and distributed around the bit body are axial grooves or flutes and consisting of fairly wide shallower flutes 16 and longer and deeper but somewhat more narrow flutes or grooves 18. These grooves, or flutes, are provided for ejecting backwardly along the bit body of the material taken from the formation being reduced, or drilled, by the bit.

Extending axially in the bit body is an air passage 18 which, at the axially lower end, has an inclined portion 20 which terminates in a hole 22 in the working face which, as will be seen in FIG. 2, is radially offset from the central axis of the bit body.

Extending across the working face 12 of the bit body from a pair of the shallower flutes 16 are grooves 24 which terminate at the inner ends at hole 22. Still further, groove 26 is provided leading from hole 22 radially of the working face of the bit body and terminating at one of the deeper flutes 18 in the periphery of the bit body.

In the uninterrupted regions of the working face of the bit body, there are provided axial holes in which are disposed the hard wear resistant elements 28 which protrude axially from the holes and which are advantageously formed of a cemented hard metal carbide, such as tungsten carbide. The inserts 28 are brazed or cemented or press fitted into the holes provided therefor and are those elements which accomplish the actual reduction of material when the bit is in operation.

Distributed along the bevelled portion 14 of the bit body and located between adjacent ones of the flutes 16, 18, are further holes in which further hard wear resistant inserts 30 are mounted. These inserts extend angularly to the bit axis, diverging therefrom in the axially outward direction, and protrude at least a small amount outwardly from the outer periphery of the bit and are provided not only for carrying out cutting operations, but for maintaining the size, or gauge, of the hole being drilled.

Figure 3:
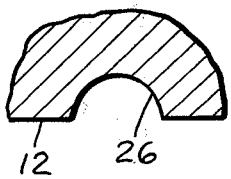
FIG. 3 is a sectional view indicated by line III—III on FIG. 2.

As will be seen in FIG. 3, which is a section through a typical one of grooves 24, 26, the grooves formed in the working face of the bit may be substantially semicircular with outwardly tapering side walls. The formation of the groove in the manner described detracts the least from the strength of the bit body and provides a passage for the flow of debris therealong of adequate size while the configuration of the groove is such that it will not become obstructed by debris becoming lodged therein.

Modifications may be made within the scope of the appended claims.

What is claimed is:

1. In a bit for drilling in earth formations; a body, a planar working face on one end of the body perpendicular to the longitudinal axis of the body, hard wear resistant inserts carried by said body and protruding axially from said working face in distributed relation, a single passage extending longitudinally through said body and terminating in a single port in the plane of said working face for the supply of fluid to said working face, axial flutes formed in the periphery of said body and extending therealong from said working face, and generally radial grooves formed into said working face and leading from the working face end of said passage to respective ones of said flutes, said working face of the bit being disposed in a single plane which is interrupted only by said grooves and said port.

2. A bit according to claim 1 in which each said groove is substantially semi-circular in cross section.

3. A bit according to claim 1 in which said passage extends along the axis of said body to near said working face and then angles off from the axis of the body so as to emerge through said working face at an eccentric location thereby forming said port in the plane of said working face, said inserts being distributed radially and circumferentially in said body so as to protrude from the working face in the region thereof between said grooves and including at least one insert near the axis of said body.

4. A bit according to claim 1 in which said body has a bevel about the periphery of said working face, and gauge inserts in the body protruding angularly from said bevel.

* * * * *